US006942112B2

(12) United States Patent
Robbins, III

(10) Patent No.: US 6,942,112 B2
(45) Date of Patent: Sep. 13, 2005

(54) ROUND DISPLAY RACK

(76) Inventor: Edward S. Robbins, III, 2802 Avalon Ave., Muscle Shoals, AL (US) 35661

( * ) Notice: Subject to any disclaimer, the term of this patent is extended or adjusted under 35 U.S.C. 154(b) by 0 days.

(21) Appl. No.: 10/705,484

(22) Filed: Nov. 11, 2003

(65) Prior Publication Data

US 2005/0098519 A1 May 12, 2005

(51) Int. Cl.[7] ..... A47F 5/08
(52) U.S. Cl. ..... 211/113
(58) Field of Search ..... 211/113, 45, 85.2, 211/13.1, 46, 58, 78, 85.29, 115, 163, 198, 205

(56) References Cited

U.S. PATENT DOCUMENTS

| | | | | | |
|---|---|---|---|---|---|
| 305,381 | A | * | 9/1884 | Forsaith | 242/594.1 |
| 402,885 | A | * | 5/1889 | Babcock | 211/113 |
| 591,453 | A | * | 10/1897 | Chickering | 211/45 |
| 2,595,837 | A | * | 5/1952 | Freeman | 211/10 |
| 3,314,177 | A | | 4/1967 | Mies, Jr. et al. | |
| 3,984,002 | A | * | 10/1976 | Howard | 211/45 |
| 4,361,241 | A | * | 11/1982 | Stoddard | 211/123 |
| 4,981,227 | A | | 1/1991 | Ingram | |
| 5,152,404 | A | | 10/1992 | Salrin et al. | |
| 5,257,694 | A | | 11/1993 | Wallach | |
| 5,462,178 | A | | 10/1995 | Wallach et al. | |
| 6,131,745 | A | | 10/2000 | Baker, Jr. | |
| 6,273,277 | B1 | | 8/2001 | Geldenhuys | |
| 6,308,842 | B1 | | 10/2001 | Robbins, III et al. | |

* cited by examiner

*Primary Examiner*—Sarah Purol
(74) *Attorney, Agent, or Firm*—Brinks Hofer Gilson Lion

(57) ABSTRACT

A display rack includes a plurality of vertical rods having lower and upper ends. A plurality of inwardly directed arms have inner ends and have outer ends that are connected adjacent to the upper ends of the vertical rods. A core member joins the inner ends of the inwardly directed arms together. At least one horizontal loop is fixed adjacent to outer ends of the inwardly directed arms. Apparatus can maintain the lower ends of the vertical rods in fixed relation to each other. Each horizontal loop can include a plurality of downwardly depending hooks. Desk chair mats can be suspended from the horizontal loop, preferably by the hooks. An upstanding cylindrical graphics-bearing surface can be supported upon the inwardly directed arms. The rack can be supported on a rotatable base.

28 Claims, 6 Drawing Sheets

Fig. 3
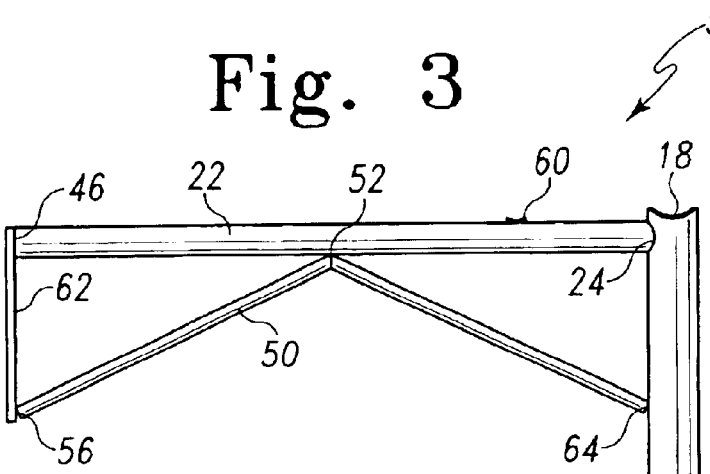
Fig. 5
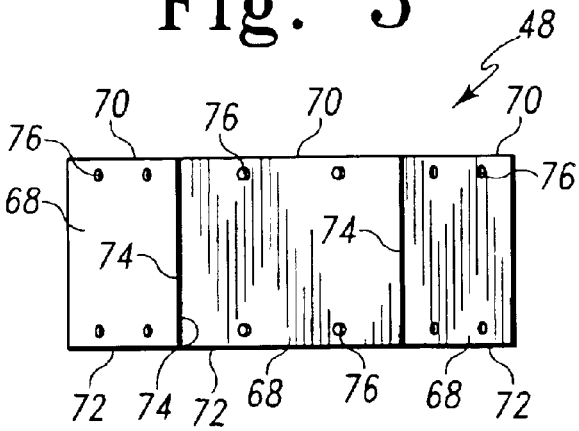
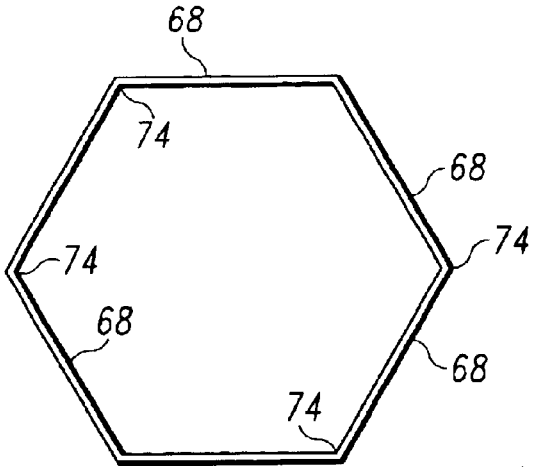
Fig. 6
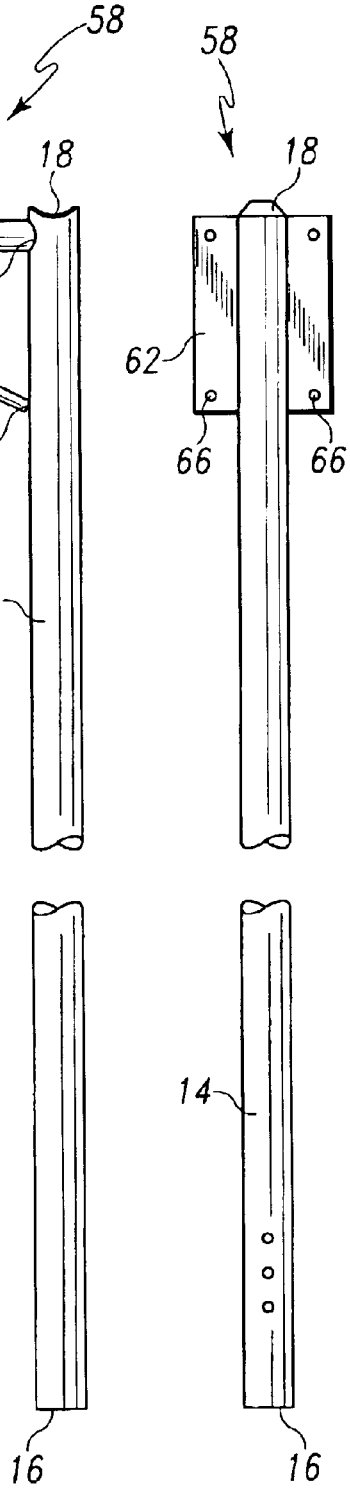
Fig. 4

ROUND DISPLAY RACK

BACKGROUND

The present invention pertains generally to support racks for the suspended display of a plurality of sheet-like goods, and particularly to such racks used for retail display of desk chair mats.

Desk chair mats for office and home use are well known. Such chair mats can simply be rectangular or can have a main portion on which the desk chair rolls, and a forward lip portion which is adapted to extend partially under the desk well, and on which the feet of the person sitting in the chair may rest. Desk chair mats which are to be applied over carpeting typically have short spikes, which can be relatively sharp, on the undersides thereof that hold the mats firmly in place.

Generally, desk chair mats are sold at office supply stores. Conventional desk chair mats present unique display problems due in part to their bulky and somewhat unwieldy configuration, and in part to the hazard presented by any sharp spikes on the undersides of the mats. Several attempts have been made at creating visually satisfactory displays of such mats. For example, U.S. Pat. No. 6,308,842 discloses several retail display stands that generally include a pair of vertical standards that can be braced by horizontal reinforcement rods and are supported on a pair of leg assemblies. The leg assemblies include horizontal feet and vertical extensions that are telescoped within the lower ends of standards and secured, if desired, by a conventional detent mechanism. One or more horizontal display rods are fixed generally perpendicularly to the reinforcement rod. A number of hooks are fixed to depend from the display rod to receive the chair mats for display. An advertising panel can be added between the standards above the display rod. The chair mats can be suspended from the hooks in either a planar or folded conformation, the latter being preferred. The suspended chair mats can easily be removed from the hooks by a retail consumer. While such displays operate quite satisfactorily in some locations, the essentially bi-lateral presentation of the goods and related display advertising limits the visual appeal presented in other locations. This deficiency is not addressed by U.S. Pat. No. 5,257,694.

Alternatives to the essentially bilateral presentation of such goods are explored by the display assemblies found in U.S. Pat. Nos. 5,152,404 and 5,462,178. The former patent discloses a plurality of vertically spaced standards mounted to horizontally spaced display columns, such as along a wall of peg board commonly used in retail environments. A plurality of left-handed outwardly projecting fixtures are clamped along one tier of the standards so that the products, such as floor mats, are supported to face generally toward the left of the display. On another tier of standards, a plurality of right-handed fixtures are clamped to display a plurality of products oriented to face generally toward the right of the display. When positioned along a wall, retail consumers can see essentially all of the goods being displayed from a wide approach angle. A somewhat similar visual appeal is achieved by the display disclosed in U.S. Pat. Nos. 5,462,178 that has one or more vertical poles spaced from a wall. One or more triangular racks are rotatable about each pole, each side of each rack having an outwardly extending arm to carry the floor mats or similar goods in a suspended or hanging display.

A further enhanced visual presentation of goods can be achieved through a central open floor presentation with the aid of a circular, or substantially circular, rack as shown, for example, in U.S. Pat. Nos. 3,984,002; 4,981,227 and 6,131,745. In the most recent of these three patents, a small item display and a graphic panel display are attached to the top of the structure. When such racks are sufficiently spaced from any adjacent wall or other obstruction, a purchaser can walk around the rack to inspect the displayed goods. When such racks are situated adjacent to a wall, the wall acts as an impediment to inhibit the selection process.

Thus, there remains a need for a display rack that can optionally be situated adjacent to a wall yet permit consumer easy access to all the desk chair mats or similar articles displayed on the rack that also provides a wide angle visual informative appeal to the shopping consumer. There is also a need for such a rack that is capable of supporting the often bulky and somewhat unwieldy articles in a convenient suspended display that will easily permit selection by the shopping consumer.

SUMMARY OF THE INVENTION

Accordingly, the present invention is directed to a display rack for displaying desk chair mats and similar sheet-like goods that includes a plurality of vertical rods having lower and upper ends. A plurality of inwardly directed arms have inner ends and have outer ends that are connected adjacent to the upper ends of the vertical rods. A core member joins the inner ends of the inwardly directed arms together. At least one horizontal loop is fixed adjacent to outer ends of the inwardly directed arms. Apparatus is provided to maintain the lower ends of the vertical rods in fixed relation to each other. Each horizontal loop can include a plurality of downwardly depending hooks. The desk chair mats or other goods are suspended from the horizontal loop, preferably by the hooks. An upstanding graphics-bearing surface can be supported upon the inwardly directed arms.

The lower ends of the vertical rods can be connected by an assembly of bars that will counteract any tendency for the lower ends to splay outwardly. The lower ends of each vertical rod can also be received in a recess in a top surface of a rotatable base designed to permit the display rack as a whole to rotate to facilitate selection of a desired chair mat. Such a rotatable base is particularly useful in situations where the display rack is to be positioned in a corner or adjacent to a wall since such positioning will not detract from product access.

The graphics-bearing surface can initially be created in planar form and then reconfigured to a final cylindrical or polygonal form that can stand upright on the upper surface of the plurality of inwardly directed arms. The graphics on the surface can bear any suitable information, but preferably bears product information related to the adjacent products, which can be arranged in suitable groups to facilitate selection by the consumer. Various attributes of the products can beneficially be displayed on the graphics-bearing surface to discourage un-necessary unwrapping of the products prior to purchase.

Since desk chair mats are rather bulky, it is necessary for the rack to be able to support the considerable weight representing a significant number of such mats. This is accomplished with the aid of a core member of suitable construction to bear the inward forces generated upon suspension of a large number of mats on the rack. While a number of core shapes are possible including cylindrical, a particularly useful core member shape is a polygonal core having the same number of sides as the number of inwardly directed arms. The inner ends of the arms can be fastened to faces or corners of the polygonal member, optionally with the aid of support plates fixed to the inner ends of the arms. Trusses or other braces can be added to help support the inwardly directed arms and the weight of the desk chair mats that are suspended from each of the horizontal loops.

One of the horizontal loops can be positioned directly on the top end of the vertical rods. The horizontal loops can be connected to the top surface of the inwardly directed arms. Hook assemblies can be connected to discrete segments of any of the horizontal loops to facilitate the suspended display of the desk chair mats. The separately attachable hook assemblies allow for modification of the display to accommodate any changes in commercial offerings.

Additional features and advantages of the present invention will become apparent to those skilled in the art from a consideration of the following discussion of preferred embodiments that referenced the accompanying drawings.

BRIEF DESCRIPTION OF THE DRAWINGS

FIG. 3 is an elevation view of one the support arm of the support rack shown in FIG. 2.

FIG. 4 is an elevation view of the support arm as viewed from the right side of FIG. 3.

FIG. 5 is an elevation of the central hexagonal support used in the support rack of FIG. 2.

FIG. 6 is a plan view of the central hexagonal support shown in FIG. 5.

DETAILED DESCRIPTION OF PREFERRED EMBODIMENTS

Figure 1:
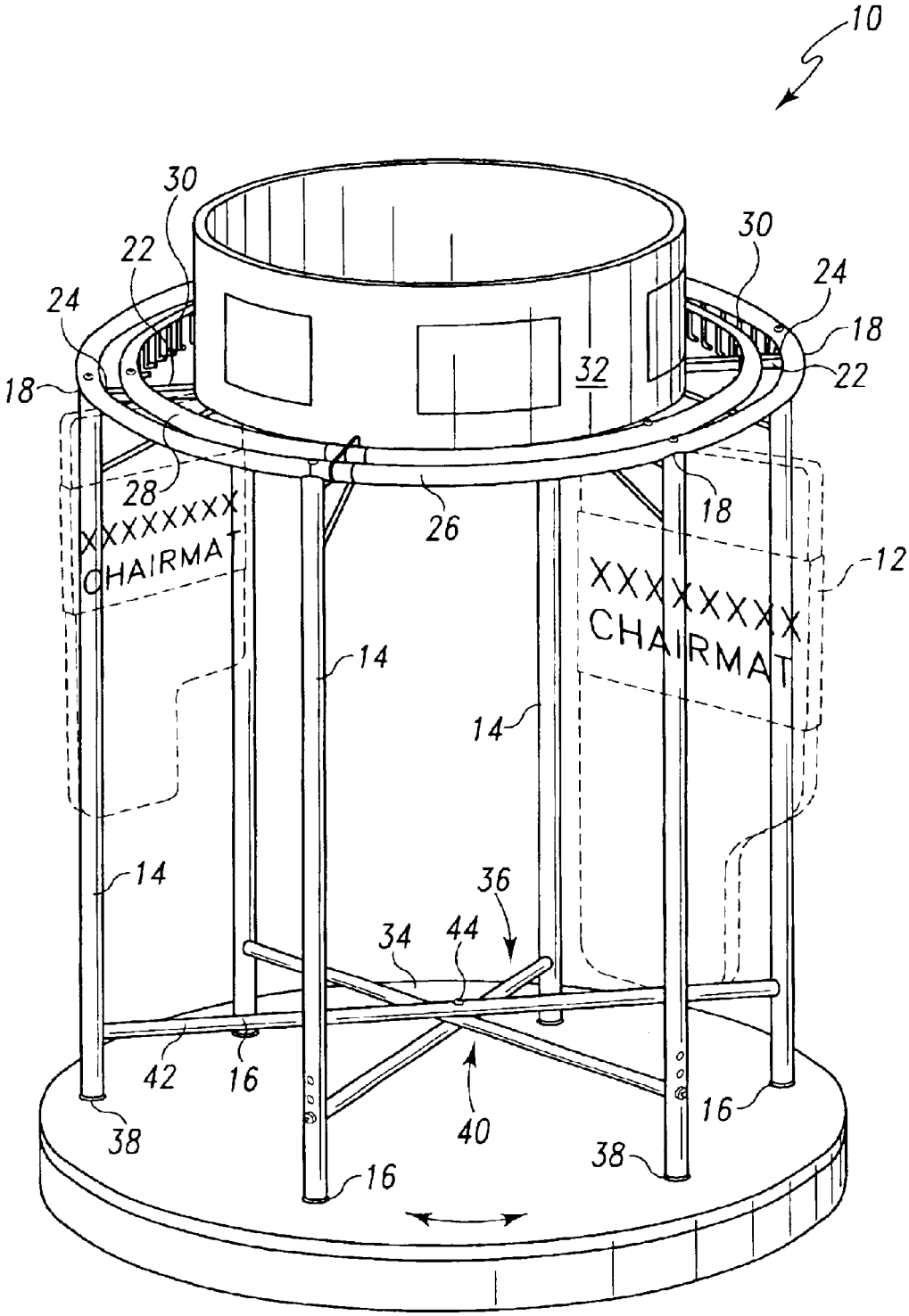
FIG. 1 is a perspective view of a round support rack of the present invention.

FIG. 1 shows a perspective view of a display rack 10 exemplary of the present invention that can be advantageously used for displaying desk chair mats 12 and similar goods. The display rack 10 includes a plurality of vertical rods 14 that have lower ends 16 and upper ends 18. While FIG. 1 shows the display rack 10 to include six vertical rods 14, the precise number of rods is generally a matter of design and may vary without departing from the present invention. A plurality of inwardly directed arms 22 have outer ends 24 that are connected to the vertical rods 14 adjacent to the upper ends 18. A first horizontal loop 26 is fixed to the upper ends 18 of the vertical rods 14. A second horizontal loop 28 is fixed to the upper surface of the inwardly directed arms 22. The first and second horizontal loops 26 and 28 are shown to be circular and concentric, however, the horizontal loops could be of any convenient shape that defined a closed loop. The precise number and location of the horizontal loops can vary from that illustrated without departing from the present invention. A plurality of hooks 30 can be connected to the first and second horizontal loops 26 and 28 from which the desk chair mats 12 are suspended.

A graphics panel 32 is shown to be situated on and supported by the upper surface of the arms 22 inside the second horizontal loop 28. The graphics panel 32 is shown to be cylindrical, but other geometric shapes are also possible. The graphics panel 32 can advantageously display information concerning the adjacent goods 12 hung on the display rack 10. The goods 12 can be grouped around the horizontal loops 26 and 28 based on a visible criterion such as size or shape of the goods 12. The graphics panel 32 can includes graphics adjacent to each group of the goods 12 depicting the visible criterion. The display rack 10 can include a base 34 supporting the lower ends 16 of the vertical rods 14. The base 34 preferably rotates in response to a suitable force applied to the rack 10. Apparatus 36 is provided to maintain the lower ends 16 of the vertical rods 14 in fixed relation to each other. The apparatus 36 can simply consist of a recess 38 in the top surface of the base 34 that receives each vertical rod lower end 16. The apparatus 36 can also consist of a support assembly 40 that includes a plurality of bars 42, each bar 42 being connected to two of the vertical rods 14 adjacent to the lower ends 16. The bars 42 are shown in FIG. 1 to be spanning a diameter of the rack 10 and to include a connector 44 connecting a central portion of the bars 42 to each other. The bars 42 can be alternatively arranged to span a cord or other portion of the rack 10 as shown, by way of example, in FIG. 2.

Figure 2:
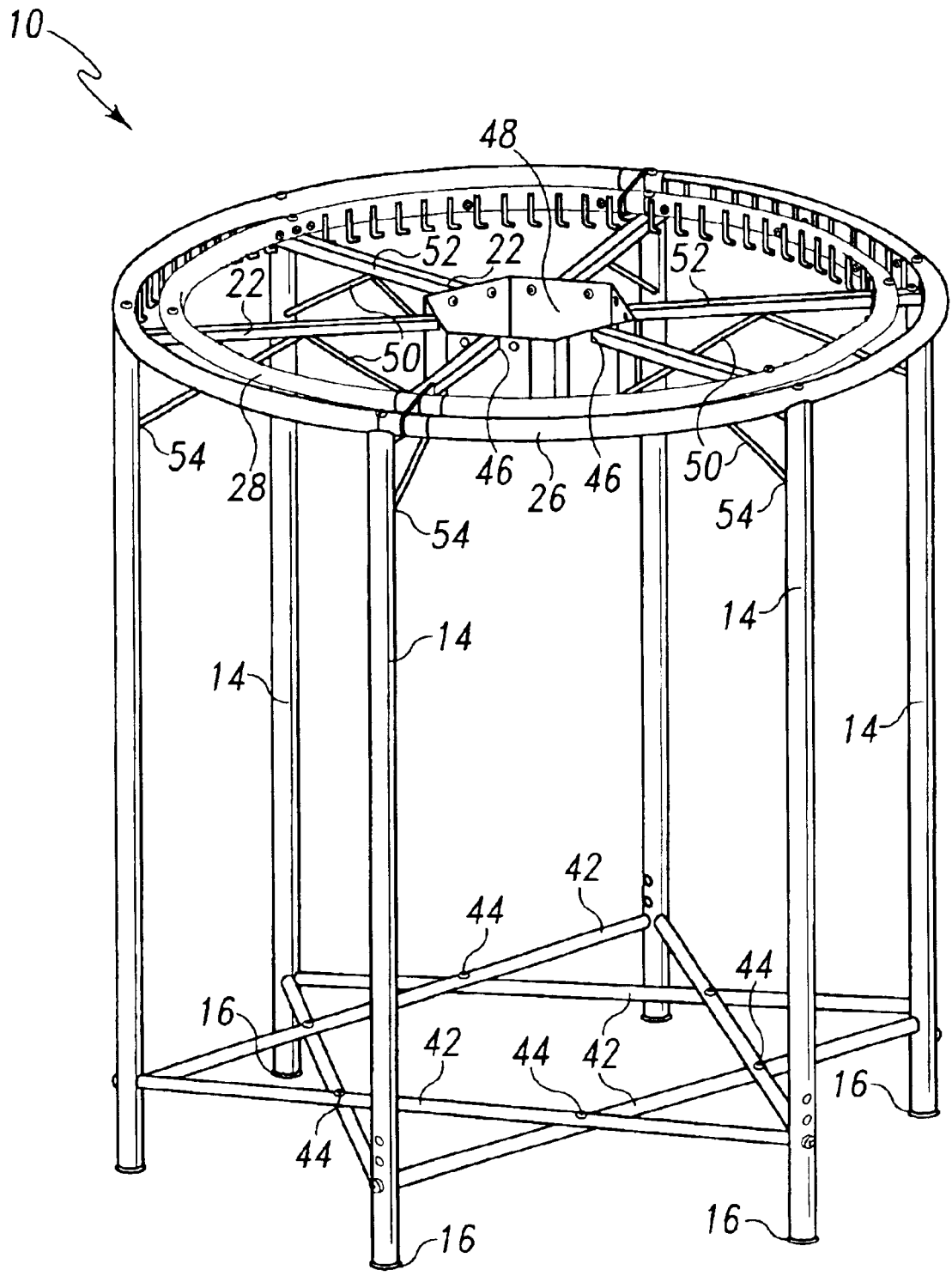
FIG. 2 is another perspective view of a round support rack of the present invention.

In FIG. 2, the bars 42 of the display 10 are shown to be connected to next-nearest neighboring vertical rods 14 and to include connectors 44 at two central locations on each bar 42. Other configurations falling within the present invention will be apparent to those skilled in the art on the basis of the two representative examples of FIGS. 1 and 2. FIG. 2 additionally shows that each of the inwardly directed arms 22 include an inner end 46 that is coupled to a core member 48. The core member 48 is shown to be hexagonal, but can also be cylindrical or polygonal with the number of sides generally corresponding to the number of vertical rods 14. The inner ends 46 of the inwardly directed arms 22 are shown to be joined to one face of the core member 48, however, it is possible that the inner end 46 could be suitably configured to join a corner of a polygonal core. Each of the inwardly directed arms 22 is also seen to be supported by a truss member 50 that joins a central portion 52 of the arm 22 to a point 54 on the adjacent vertical rod below the outer end 24 of the arm 22. The truss member 50 also is seen, particularly in FIGS. 3 and 4, to join a central portion 52 of the arm 22 to a portion 56 of the core member 48 below the inner end 46.

FIG. 3 is a side elevation view of a leg assembly 58 for the rack 10. FIG. 4 is an elevation view of the leg assembly 58 as seen from the right side of FIG. 3. The leg assembly 58 is seen to include a vertical rod 14 having lower end 16 and upper end 18. The leg assembly 58 also includes an inwardly directed arm 22 that has an outer end 24 connected to the vertical rod 14 adjacent to the upper end 18. The inwardly directed arm 22 includes a fastener 60 in a top surface for fastening the arm 22 to the horizontal loop 28, discussed previously. The inwardly directed arm 22 includes an inner end 46 that can be fixed to an abutment plate 62. The truss member 50 can be seen to join a central portion 52 of the arm 22 to a portion 56 of the core abutment plate 62 below the inner end 46 of arm 22. The truss member 50 can also be seen to join the central portion 52 of the arm 22 to a point 64 on vertical rod 14 situated below the outer end 24 of arm 22. The abutment plate 62 can be seen in FIG. 4 to include a pattern of holes 66 to receive fasteners for fastening the abutment plate 62 to the core member 48 as shown, for example, in FIG. 2. An exemplary core member 48 is shown in greater detail in FIGS. 5 and 6.

The core member 48 can be seen in FIGS. 5 and 6 to comprise a plurality of planar plates 68, each plate having a top edge 70, a bottom edge 72 and lateral edges 74. Each plate 68 is fixed to the two adjacent plates along their lateral edges 74 so that the top edges 70 are aligned with each other as are the bottom edges 72. The number of plates 68 can be selected to correspond to the number of leg assemblies 58 that are to be joined to the core member 48. In the illustrated example, the core member 48 includes six plates 68 that together form an open hexagonal cylinder, which is seen in plan view in FIG. 6. Each of the plates 68 can also include a pattern of holes 76, which can correspond to the pattern of holes 66 in the abutment plates 62, to receive fasteners for fastening the abutment plate 62 to the core member 48 as previously discussed. While the abutment plates 62 are shown to be planar, the conformation of the plates 62 can be concave or angular, but generally should be that necessary to conform to the core member 48 actually employed.

Figure 7:
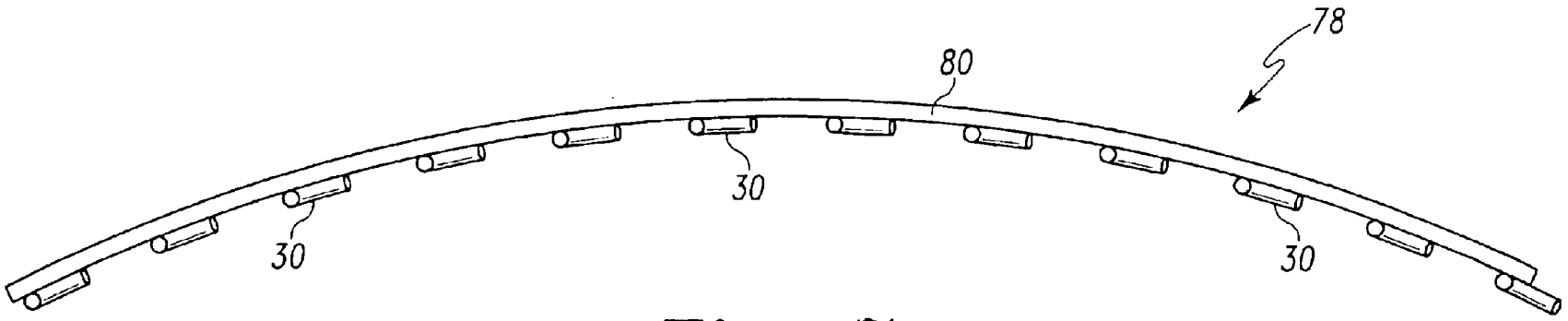
FIG. 7 is a plan view of a hook ring assembly employed the in display rack of FIG. 2.
Figure 8:
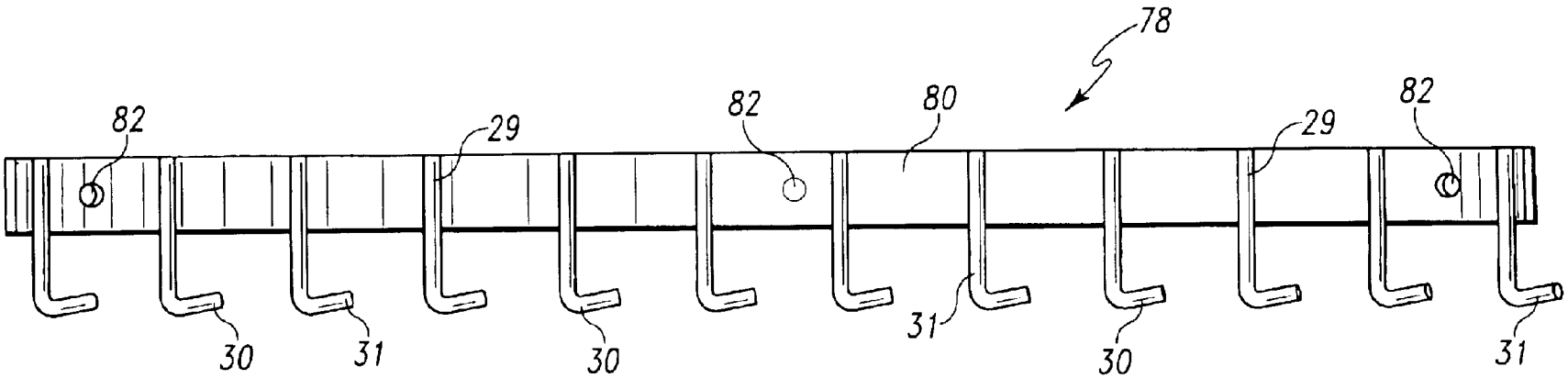
FIG. 8 is an elevation view of the hook ring assembly shown in FIG. 7.

As indicated previously in connection with FIGS. 1 and 2, a plurality of hooks 30 can be connected to the first and second horizontal loops 26 and 28 from which the desk chair mats 12 can be suspended. The hooks 30 can be connected together in the form of a hook assembly 78 as shown in FIGS. 7 and 8. A hook assembly 78 includes a support bar 80 that is generally shaped to correspond to the shape of one of the horizontal loops. As illustrated, for example, the hook assembly 78 can be generally curved to correspond to the curvature on the horizontal loop to which the assembly is to be mounted. The hooks 30 can be fastened to the bar 80 by any convenient means such as welding or brazing a stem portion 29 to the bar 80 so that a hook portion 31 depends downwardly from the bar 80. The bar 80 can be mounted to one of the horizontal loops using suitable fasteners that will pass through holes 82 in the bar 80, with the fasteners being engaged in an adjacent horizontal loop. The bar 80 can be conveniently designed to extend fully between adjacent leg assemblies 58, but can also cover other arcuate portions of the horizontal loops 26 or 28.

Figure 9:
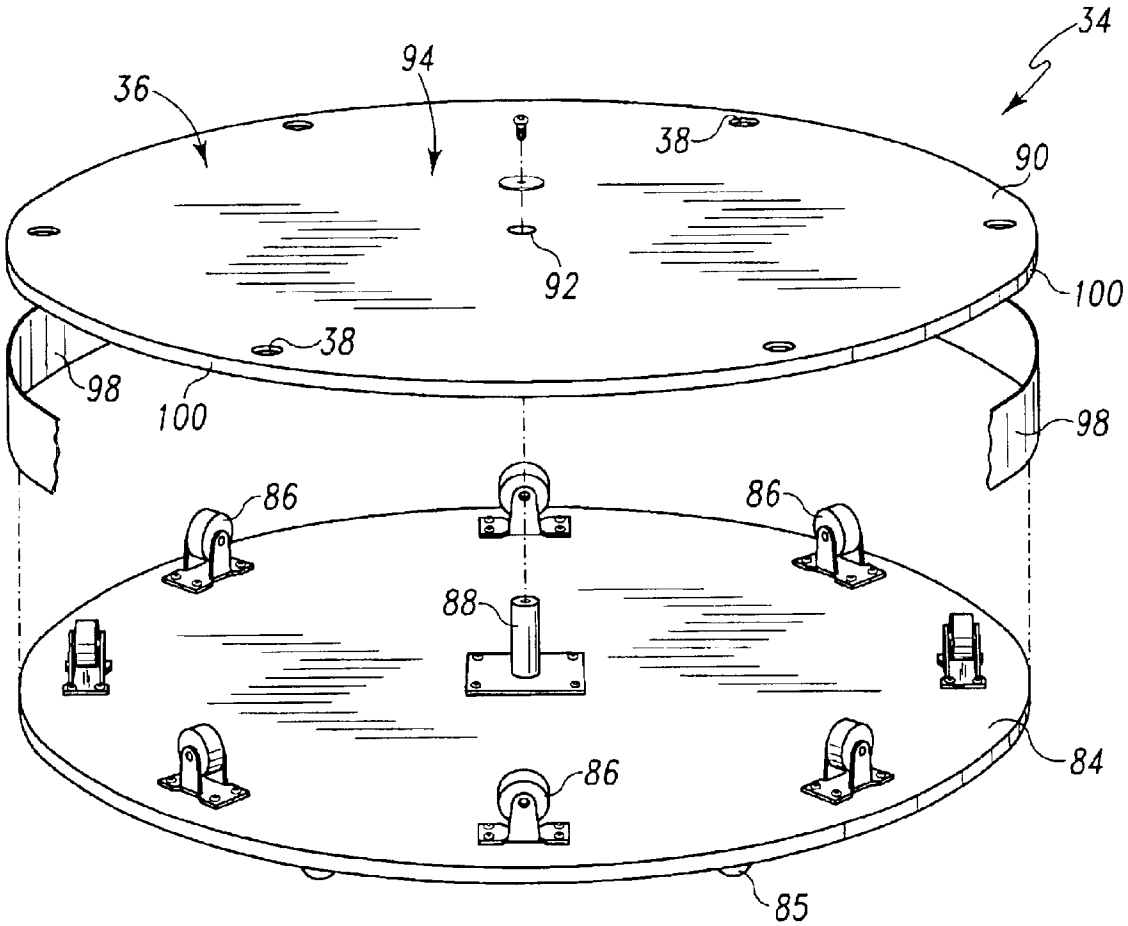
FIG. 9 is an exploded view of a turn table for supporting a round display rack as shown in FIG. 1.

A display rack base 34 such as that shown in FIG. 1, is illustrated in greater detail in FIG. 9. The display rack base 34 is seen to have a bottom member 84 that can be circular and include feet 85 for supporting the display rack base 34 on any suitable underlying surface. A plurality of rollers 86 can extend upward from the bottom member 84 that are aligned with each other in a generally circular arrangement. An upwardly extending axial member 88 can also be fixed to a central portion of the bottom member 84. A top member 90 of the base 38 can overlie the bottom member 84 and rest upon the tops of the rollers 86. The top member 90 can include a central opening 92 to receive the axial member 88 to assure that only rotational movement is permitted between the top member 90 and the bottom member 84. The top member 90 has an upper surface 94 that can include the recesses 38 intended to receive the lower end 16 of the vertical rods 14. A perimeter mask 98 can be fixed to the outer edge 100 of the top member 90 to inhibit the intrusion of foreign objects between the top member 90 and the bottom member 84.

It will be appreciated that the rollers 86 could be attached to the lower surface of the top member 90 with substantially equivalent effect. If will further be appreciated that with the rollers 86 attached to the lower surface of the top member 90, the bottom member 84 might be omitted so that the rollers 86 could contact any underlying surface.

Figure 10:
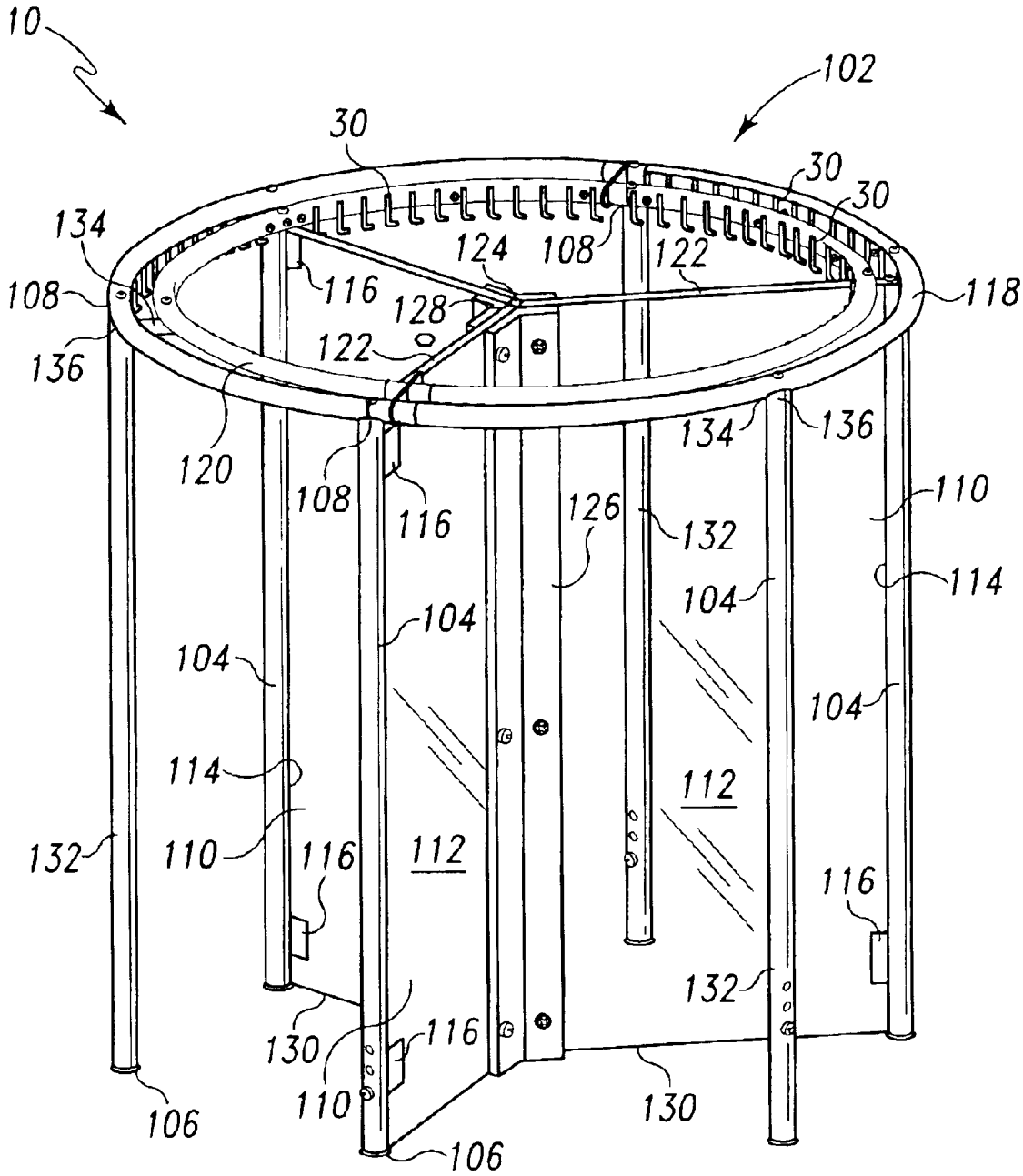
FIG. 10 is a perspective view of a further variation of a round support rack of the present invention.

Another embodiment 102 of a display rack 10 of the present invention is shown in FIG. 10 to include a plurality of vertical rods 104 that have lower ends 106 and upper ends 108. While FIG. 10 shows the display rack 102 to include six vertical rods 104, the precise number of rods is generally a matter of design and may vary without departing from the present invention. A plurality of inwardly directed arms 110 in the form of sheet members 112 have outer edges 114 that are connected by clips 116 to at least some of the vertical rods 104 adjacent to the lower ends 106 and the upper ends 108. The sheet members 112 can be formed of tempered glass, metal, plastic or other material that will endure the various forces that will be presented by the goods displayed on the rack 102. While FIG. 10 shows the display rack 102 to include three vertical sheet members 112, the precise number of sheet members is generally a matter of design and may vary without departing from the present invention. A first horizontal loop 118 is fixed to the upper ends 108 of the vertical rods 104. A second horizontal loop 120 is fixed to the upper edge 122 of the inwardly directed sheet members 112. The first and second horizontal loops 118 and 120 are again shown to be circular and concentric, however, the horizontal loops could be of any convenient shape that defined a closed loop. The precise number and location of the horizontal loops can vary from that illustrated without departing from the present invention.

A core member 124 in the form of plurality of angle members 126 joins the adjacent inner edges 128 of the sheet members 112 together. The angle members can be coupled to each other by fasteners passing through openings in the sheet members 112. While the angle members 126 are shown to be vertically continuous from the upper edge 122 of the sheet members 112 down to the bottom edge 130, the exact vertical extent of the core member 124 is a function of both structural strength and design considerations. The angle members 126 and clips 116 adjacent to the bottom edge 130 of the sheet members 112 act to maintain the lower ends 106 of the vertical rods 104 in fixed relation to each other. FIG. 10 shows the display rack 102 to include some vertical rods 104 that are not connected to corresponding sheet members 112. These unconnected vertical rods 132 can include brackets 134 connecting their upper ends 136 to the horizontal loops 118 and 120. Alternatively, the unconnected vertical rods 132 can be omitted if the structural strength of the other elements of the display rack 102 is sufficient to hold bear the forces that will be presented by the goods displayed on the rack 102.

A plurality of hooks 30, similar in structure to that shown in FIGS. 7 and 8, can be connected to the first and second horizontal loops 118 and 120 from which desk chair mats 12 or other sheet like goods can be suspended. A graphics panel 32, similar to that shown in FIG. 1, can be situated on and supported by the upper surface 122 of the sheet members 112. The graphics panel 32 can be cylindrical, as shown in FIG. 1, but other geometric shapes are also possible. The graphics panel 32 can advantageously display information concerning the adjacent goods 12 hung on the display rack 102. The display rack 102 can be supported on a base 34 similar to that shown in FIGS. 1 and 9 that rotates in response to a suitable force applied to the rack 102.

The foregoing detailed description should be regarded as illustrative rather than limiting, and the following claims, including all equivalents, define the spirit and scope of this invention.

What is claimed is:

1. A display rack specially adapted for the display of a plurality of suspended sheet goods comprising:

a plurality of vertical rods having lower and upper ends, a horizontal loop fixed adjacent to the upper ends of the vertical rods, a plurality of inwardly directed arms having outer ends connected to the upper ends of the vertical rods and inner ends, a support plate fixed to each inner end, a core member coupled to all the support plates to join the inner ends of the inwardly directed arms together, and a plurality of hooks depending from the horizontal loop to hold goods in suspended display.

2. The display rack of claim 1 further comprising a lower support assembly coupled to the lower ends of the vertical rods to maintain the lower ends in fixed relation to each other.

3. The display rack of claim 1 further comprising a second horizontal loop fixed to the inwardly directed arms, and a second plurality of hooks depending from the second horizontal loop.

4. The display rack of claim 1 wherein the core member comprises a plurality of outwardly facing planar surfaces, and each support plate is coupled to one of the planar surfaces.

5. The display rack of claim 1 further comprising a truss coupling each inwardly directed arm to the vertical rod and support plate fixed thereto.

6. The display rack of claim 1 further comprising an upstanding graphics-bearing surface supported upon the inwardly directed arms.

7. The display rack of claim 1 further comprising a rotatable base supporting the lower ends of the vertical rods.

8. The display rack of claim 7 wherein the rotatable base includes a recess to receive the lower end of each of the vertical rods.

9. The display rack of claim 1 wherein at least some of the inwardly directed arms comprise vertically oriented sheet members, each sheet member having an outer edged joined to the vertical rod adjacent thereto, and an inner edge joined to the core member.

10. A display rack specially adapted for the display of a plurality of suspended sheet goods comprising:

a plurality of vertical rods having lower and upper ends, a plurality of inwardly directed arms having outer ends connected to the upper ends of the vertical rods and inner ends, support plates fixed to each inner end of the inwardly directed arms, each support plate being coupled to a core member joining the inner ends of the inwardly directed arms together, a horizontal loop fixed to the inwardly directed arms, and a plurality of hook assemblies having a plurality of hooks depending therefrom, each hook assembly being attached to a portion of the horizontal loop between adjacent inwardly adjacent arms to hold goods in suspended display.

11. The display rack of claim 10 wherein the core member comprises a polygonal member having a plurality of outwardly facing planar surfaces, and each support plate is coupled to one of the planar surfaces.

12. The display rack of claim 10 further comprising a truss coupling each inwardly directed arm to the vertical rod and support plate fixed thereto.

13. The display rack of claim 10 further comprising means for retaining the lower ends of the vertical rods in fixed relation relative to each other.

14. The display rack of claim 13 wherein at least some of the inwardly directed arms comprise vertically oriented sheet members, each sheet member having an inner edge joined to the core member, and an outer edged joined to the vertical rod adjacent thereto at two locations, one of the locations being adjacent the adjacent vertical rod lower end.

15. A display comprising:

a rack including a plurality of vertical rods having lower and upper ends, a plurality of inwardly directed arms having outer ends connected to the upper ends of the vertical rods and inner ends, a polygonal core member joining the inner ends of the inwardly directed arms together, and a pair of horizontal loops fixed adjacent to outer ends of the inwardly directed arms, a plurality of sheet goods depending from the horizontal loops in suspended display, and an upstanding cylindrical graphics-bearing surface supported upon the inwardly directed arms.

16. A display according to claim 15 wherein the sheet goods are grouped around the horizontal loops based on a visible criterion of the goods, and the graphics-bearing surface includes graphics adjacent to each group depicting the visible criterion.

17. A display according to claim 15 further comprising a plurality of hook assemblies having a plurality of hooks depending therefrom, the assemblies being selectively attached to segments of the horizontal loops between adjacent inwardly directed arms to hold the goods in suspended display.

18. A display according to claim 15 further comprising retaining means for retaining the lower ends of the vertical rods in fixed relation relative to each other.

19. A display according to claim 18 wherein the retaining means comprises a rotatable base supporting the lower ends of the vertical rods, the rotatable base including a recess to receive the lower end of each of the vertical rods.

20. A display according to claim 18 wherein the retaining means comprises a lower assembly of bars coupled to the lower ends of the vertical rods.

21. A display rack comprising a plurality of vertical rods having lower and upper ends, a plurality of vertically oriented sheet members, each sheet member having an inner edge and an outer edge, the outer edge being connected to one of the vertical rods, a core member joining the inner edges of the vertical sheet members together, a horizontal loop fixed adjacent to the upper ends of the vertical rods, and a plurality of hooks attached to a portion of the horizontal loop between adjacent vertical sheet members to hold goods in suspended display.

22. The display rack of claim 21 wherein there are a greater number of vertical rods than vertically oriented sheet members.

23. The display rack of claim 21 wherein the vertically oriented sheet members are composed of tempered glass, metal or plastic.

24. The display rack of claim 21 further comprising a second horizontal loop coupled to a top edge of the vertically oriented sheet members, the second horizontal loop including a plurality of hooks depending therefrom.

25. The display rack of claim 21 wherein the core member comprises a plurality of angular strips extending over substantially the entire vertical extent of the vertically oriented sheet members.

26. The display rack of claim 25 wherein the angular strips are coupled to each other through openings in the vertically oriented sheet members.

27. A display rack specially adapted for the display of a plurality of suspended sheet goods comprising:

a plurality of vertical rods having lower and upper ends, a horizontal loop fixed adjacent to the upper ends of the vertical rods, a plurality of inwardly directed arms having outer ends connected to the upper ends of the vertical rods and inner ends, a core member joining the inner ends of the inwardly directed arms together, an upstanding graphics-bearing surface supported upon the inwardly directed arms, and a plurality of hooks depending from the horizontal loop to hold goods in suspended display.

28. A display rack specially adapted for the display of a plurality of suspended sheet goods comprising:

a plurality of vertical rods having lower and upper ends, a horizontal loop fixed adjacent to the upper ends of the vertical rods, a plurality of inwardly directed arms having outer ends connected to the upper ends of the vertical rods and inner ends, a core member joining the inner ends of the inwardly directed arms together, at least some of the inwardly directed arms comprising vertically oriented sheet members, each sheet member having an outer edged joined to the vertical rod adjacent thereto, and an inner edge joined to the core member, and a plurality of hooks depending from the horizontal loop to hold goods in suspended display.

* * * * *